United States Patent [19]

Steinkamp et al.

[11] Patent Number: 4,884,940

[45] Date of Patent: Dec. 5, 1989

[54] LOADER BUCKET TRANSPORT LINK

[75] Inventors: John O. Steinkamp, Milford, Mich.; Garry L. Ball, Lancaster, Pa.; Daniel D. Radke, Troy, Mich.

[73] Assignee: Ford New Holland, Inc., New Holland, Pa.

[21] Appl. No.: 322,026

[22] Filed: Mar. 10, 1989

[51] Int. Cl.[4] ..... E02F 3/80

[52] U.S. Cl. ..... 414/715; 172/826; 403/108; 403/378

[58] Field of Search ..... 414/723, 685, 694, 715; 403/107, 108, 378, 379; 172/824, 826

[56] References Cited

U.S. PATENT DOCUMENTS

| | | | |
|---|---|---|---|
| 2,239,943 | 4/1941 | Sword | 172/824 |
| 2,808,666 | 10/1957 | Schneckloth | 172/826 |
| 3,148,789 | 9/1964 | Gourjon | 414/694 |
| 3,175,315 | 3/1965 | Strader | 172/826 X |
| 4,405,019 | 9/1983 | Frisbee | 172/826 X |

*Primary Examiner*—Dennis L. Taylor
*Assistant Examiner*—Arlen L. Olsen
*Attorney, Agent, or Firm*—Larry W. Miller; Frank A. Seemar; Darrell F. Marquette

[57] ABSTRACT

A connecting link for use on a bucket loader mountable on a tractor to control the pivotal movement of the bucket relative to the mounting frame to which the bucket is attached is disclosed wherein first and second members are telescopically associated to permit a varying of the effective length of the connecting link. A first pin is engageable through a first set of alignable holes through the first and second members to fix the telescopic position of the connecting link in an operative position. The first pin has a size sufficient to withstand the operating forces exerted on the connecting link during operation of the bucket. A second pin is engageable with the first and second members through a second set of alignable holes therethrough to shorten the effective length of the connecting link to a transport position and permit a rollback of the bucket for transport. The second pin has a size incapable of sustaining the operational forces exerted through the connecting link so that the bucket cannot be operated when the connecting link is in the transport position.

12 Claims, 2 Drawing Sheets

LOADER BUCKET TRANSPORT LINK

BACKGROUND OF THE INVENTION

The present invention relates generally to tractor-loader-backhoes and, more particularly, to a connecting link for controlling the pivotal movement of the bucket on the loader mounting frame.

A bucket loader pivotally connectable to a tractor to position the loader bucket forwardly of the tractor for operation is typically provided with a pair of hydraulic cylinders connectable to a pivot control linkage to control the pivotal movement of the loader bucket on the mounting frame. The range of pivotal movement of the loader bucket is defined by the maximum extension and contraction of the hydraulic cylinders. When the cylinders are completely retracted, the loader bucket is rolled back to a position corresponding to the minimum overall length of the bucket loader/tractor combination.

In some European countries, local regulations require an overall transport length which is typically smaller than the minimum overall length of the bucket loader/-tractor combination. To effect compliance with such regulations, a large bracket can be added to the loader bucket, which requires removing the loader bucket from its original mounting and the bucket repositioned into the large bracket and reconnected to the pivot control linkage, to change the mounting points. Through the use of this large bracket, the rollback of the loader bucket was sufficient to further reduce the overall length of the bucket loader/tractor combination within the requirements of the local regulations. The use of this large bracket normally requires the cooperative efforts of two people and a significant amount of time to reposition and reconnect the loader bucket to the pivot control linkage.

Accordingly, it would be desirable to provide a convenient apparatus to decrease the overall length of the bucket loader/tractor combination by attaining a greater than normal rollback of the loader bucket. Operation of the loader bucket, however, is not desirable in the corresponding transport position because of the inability to retain material within the loader bucket and because of the inability to properly engage the loader bucket with the ground for proper working thereof.

SUMMARY OF THE INVENTION

It is an object of this invention to overcome the aforementioned disadvantages of the prior art by providing a telescopic connecting link forming part of the pivot control linkage for controlling the pivotal movement of the loader bucket relative to the mounting frame to which it is attached.

It is another object of this invention to provide a pivot control linkage that can be manipulated selectively to effect an additional rollback of the loader bucket to minimize the overall length of the bucket loader/tractor combination.

It is a feature of this invention that the connecting link is formed by first and second members telescopically associated to permit a varying of the effective length of the connecting link interconnecting the hydraulic cylinder and the loader bucket.

It is an advantage of this invention that the loader bucket can be rolled back to a position undesirable for operation but one that minimizes the overall transport length of the bucket loader/tractor combination.

It is another object of this invention to provide a standard tractor bucket loader that can be manipulated to comply with regulations regarding transport length.

It is another advantage of this invention that regulations regarding overall transport length can be met without disconnecting the loader bucket from its mounting frame.

It is another feature of this invention that the loader bucket will not be operable when the connecting link is positioned in a transport position.

It is yet another advantage of this invention that the connecting pin locking the first and second members of the connecting link into a transport position cannot withstand operational forces exerted on the connecting link.

It is still another advantage of this invention that conversion of the connecting link between operative and transport positions can be conveniently and easily accomplished.

It is yet another feature of this invention that the sets of alignable holes through the first and second members corresponding to the pins used for the operative and transport positions are not simultaneously alignable.

It is a further object of this invention to provide a connecting link selectively positionable between operative and transport positions for use with a bucket loader which is durable in construction, inexpensive of manufacture, carefree of maintenance, facile in assemblage, and simple and effective in use.

These and other objects, features and advantages are accomplished according to the instant invention by providing a connecting link for use on a bucket loader mountable on a tractor to control the pivotal movement of the bucket relative to the mounting frame to which the bucket is attached wherein first and second members are telescopically associated to permit a varying of the effective length of the connecting link. A first pin is engageable through a first set of alignable holes through the first and second members to fix the telescopic position of the connecting link in an operative position. The first pin has a size sufficient to withstand the operating forces exerted on the connecting link during operation of the bucket. A second pin is engageable with the first and second members through a second set of alignable holes therethrough to shorten the effective length of the connecting link to a transport position and permit a rollback of the bucket for transport. The second pin has a size incapable of sustaining the operational forces exerted through the connecting link so that the bucket cannot be operated when the connecting link is in the transport position.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
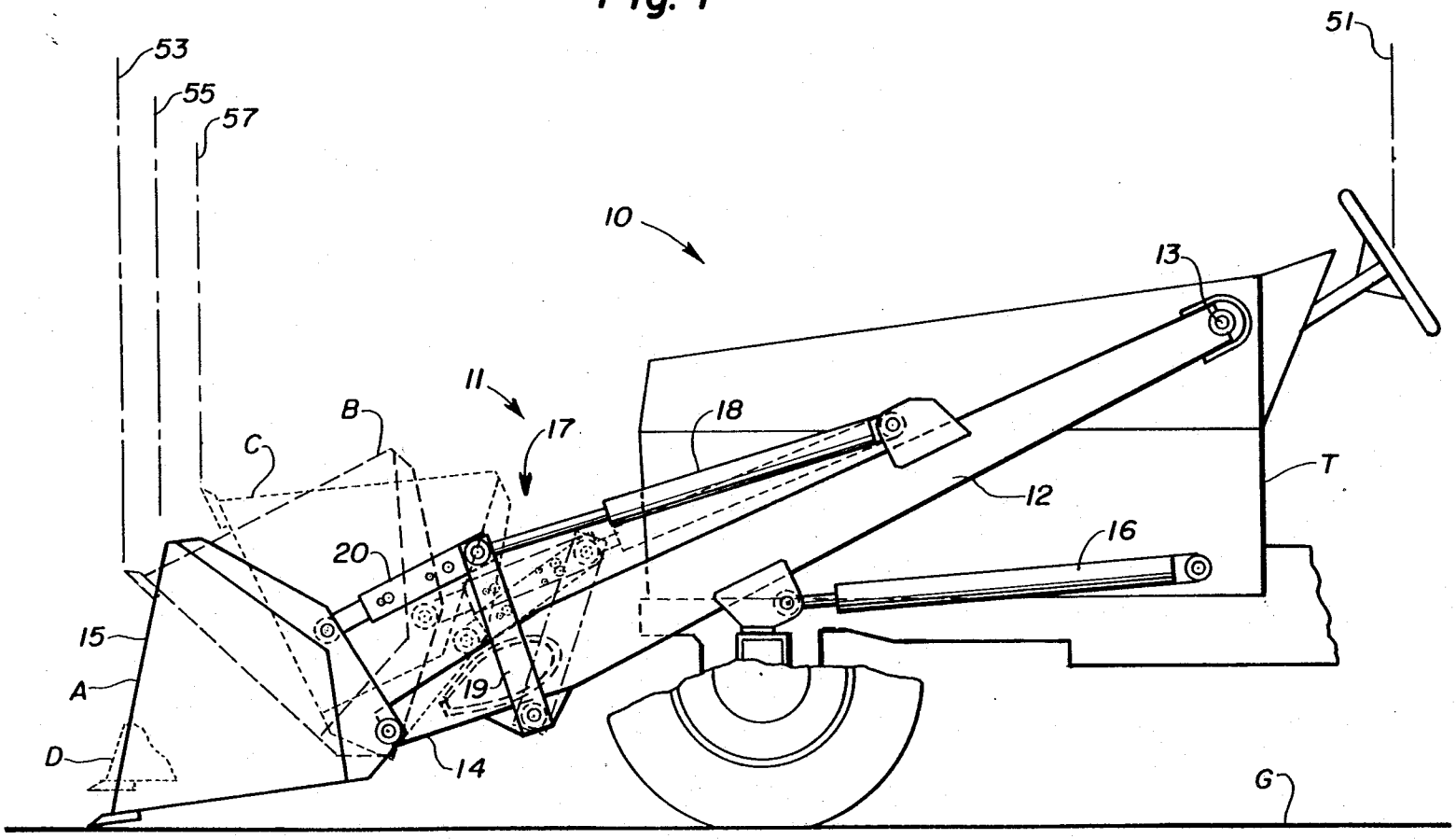
FIG. 1 is a side elevational view of a bucket loader mounted on a tractor, the rearward portions of the tractor being broken away, the range of positions of the loader bucket corresponding to the operative positions of the connecting link being shown in solid lines and in phantom, the corresponding positions of the loader bucket with the connecting link in a transport position being shown in dotted lines.

Referring now to the drawings and, particularly, to FIG. 1, a bucket loader mountable to a tractor, incorporating the principles of the instant invention, can best be seen. The bucket loader 10 includes a loader bucket 15 pivotally connected to a mounting frame 11 mounted on the tractor T for operation forwardly of the tractor T adjacent the ground G.

The mounting frame 11 is provided with a pair of transversely spaced support arms 12 positioned on opposing sides of the tractor T in a conventional manner. The support arms 12 have a first end 13 pivotally mounted on the tractor T and extending forwardly therefrom to a remote second end 14 pivotally connected to the bucket 15. Hydraulic lift cylinders 16 interconnect the tractor T and the support arms 12 in a conventional manner to provide vertical movement of the bucket 15 about the pivoted first end 13 of the support arms 12. The bucket loader 10 is also provided with a pivot control linkage 17 which includes a selectively extensible hydraulic cylinder 18, pivotally affixed to the support arms 12 and connected to a stabilizer link 19, and a connecting link 20 pivotally attached to the loader bucket 15 at a position remote from the second end 14 of the support arms 12. As is conventionally known, the hydraulic cylinder 18 controls the pivotal movement of the loader bucket 15 about the second end 14 of the support arms 12 throughout a range of movement defined by the bucket A shown in solid lines corresponding to a full extension of the hydraulic cylinder 18 and by the bucket B shown in phantom lines corresponding to a full retraction of the hydraulic cylinder 18.

In some countries of the world, local regulations require that the overall transport length of the tractor/-bucket loader combination be less than a given dimension. For standard size tractor loaders, this dimension measured from a given stationary point on a tractor, such as the steering wheel, lies behind the forwardmost point of the bucket B rolled back into its fully retracted position. Representative of these respective positions of the loader bucket 15, FIG. 1 has been provided with a vertical measuring line 51 corresponding to a fixed point on the tractor T, such as the steering wheel; a vertical measuring line 53 which corresponds to the forwardmost position of the bucket B rolled back into its fully retracted position; a vertical measuring line 55 which represents an exemplary maximum allowable forward position of the loader bucket 15 according to such regulations; and a vertical measuring line 57 which corresponds to an artificially attained rollback position of the loader bucket 15.

To provide a more convenient manner in which to artificially retract the loader bucket 15 beyond the fully retracted rollback position B, the pivot control linkage 17 is provided with a telescopic connecting link 20 which can best be seen in FIGS. 2–5. The connecting link 20 includes a first member 22 formed by a pair of transversely spaced straps 23 pivotally connectable to the hydraulic cylinder 18 at the opening 25. The end of the first member 22 remote from the opening 25 is provided with a pair of reinforcing plates 24 welded above and below the straps 23, forming a rigid box-like structure.

A second member 26 has a head 27 connectable with conventional mounting tabs (not shown) on the loader bucket 15 and a body portion 28 in the form of an elongated shaft. The first and second members 22, 26 are configured such that the body portion 28 can be telescopically received within the box-like first member 22 between the reinforcing plates 24 and the straps 23. After the second member 26 is inserted within the first member 22, a retaining plate 29 can be detachably affixed to the body portion 28 by a fastener 31. The retaining plate 29 is slightly larger than the body portion 28 such that the retaining plate 29 will engage the reinforcing blades 24 to prevent disassembly of the second member 26 from the first member 22.

The connecting link 20 is provided with the first set of holes 32 including holes 33 through the straps 23 and an alignable hole 34 through the body portion 28. The connecting link 20 is also provided with a second set of holes 37 in the form of holes 38 through the straps 23 and an alignable hole 39 through the body portion 28. It should be noted that the distance between the hole 34 and the hole 39 within the body portion 28 of the second member 26 is greater than the corresponding distance between holes 33 and holes 38 through the straps 23. Accordingly, only one set of holes 32, 37 will align at a time.

Figure 4:
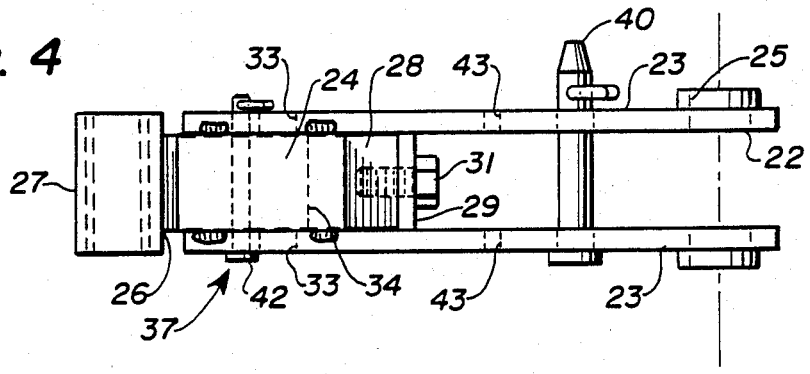
FIG. 4 is a top plan view of the connecting link corresponding to FIG. 2 except that the connecting link has been placed in a transport position.
Figure 5:
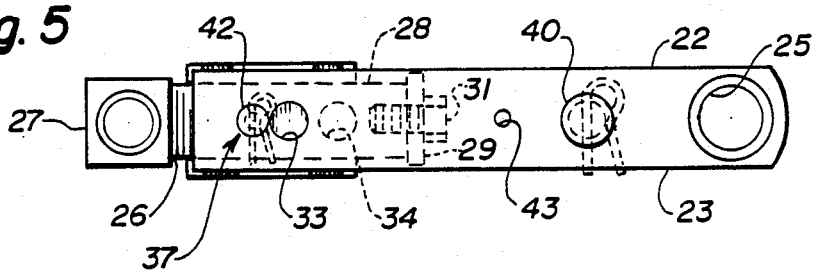
FIG. 5 is a side elevational view of the connecting link shown in FIG. 4.

When the first set of holes 32 is aligned, a first pin 40 can be inserted to limit the movement of the second member 26 relative to the first member 22. The first pin 40 has a size sufficient to withstand the operating forces exerted within the connecting link 20 during operation of the bucket loader 10, while the effective length of the connecting length 20 measured from the head 27 to the opening 25 corresponds to a standard connecting link length. To effect a transport of the bucket loader/tractor combination in compliance with regulations as described above, the connecting link 20 can be collapsed until the second set of holes 37 align for insertion of a second pin 42 to reduce the effective length of the connecting link 20 as seen in FIGS. 4 and 5. The second pin 42 is of a smaller size than the first pin 40 and cannot withstand the operating forces exerted through the connecting link 20, although the second pin 42 is of a size sufficient to restrain the connecting link 20 in the transport position shown in FIGS. 4 and 5 with the loader bucket 15 attached to permit transport thereof. As can be seen in FIGS. 2–5, the straps 23 are also provided with a pair of corresponding transport holes 41, 43 to carry the pins 40, 42 not being utilized in engagement with the first and second members 22, 26.

Figure 2:
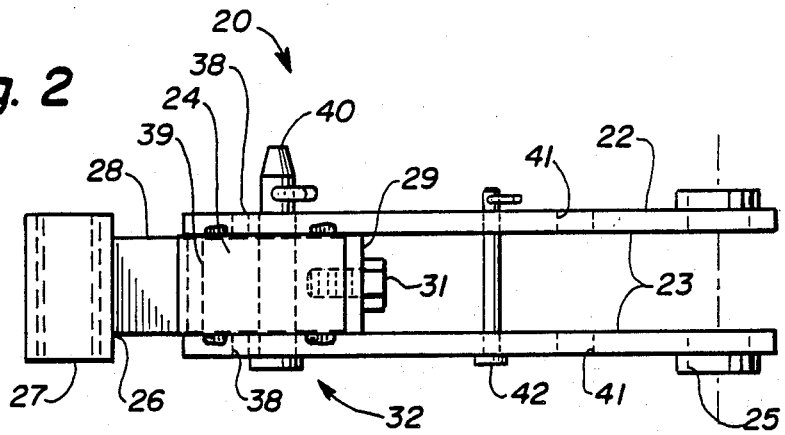
FIG. 2 is a top plan view of a connecting link interconnecting the loader bucket and the hydraulic cylinder used to control the pivotal movement of the loader bucket, the connecting link being placed in an operative position.
Figure 3:
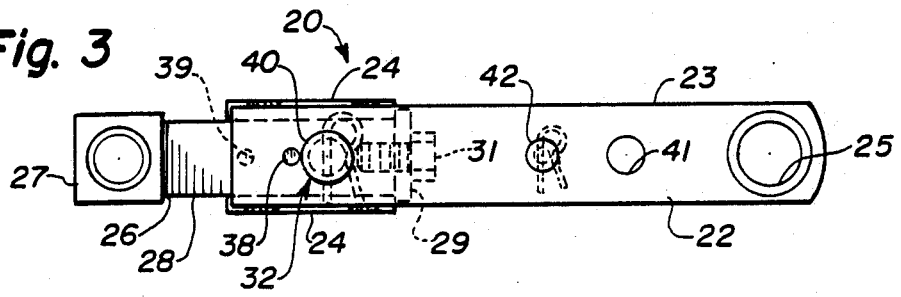
FIG. 3 is a side elevational view of the connecting link shown in FIG. 2.

In operation, the connecting link 20 will be configured as shown in FIGS. 2 and 3 with the first set of holes 32 aligned and engaged by the first pin 40 with the second pin 42 being carried in the holes 43 rearwardly of the second member 26. When the bucket loader/tractor combination must be transported in compliance with regulations requiring the forwardmost edge of the bucket 15 to be rearwardly of the vertical measuring line 55, as shown in FIG. 1, the first pin 40 is retracted from engagement with the first and second members 22, 26, and the loader bucket 15 is restrained such as being placed in the ground G while the hydraulic cylinder 18 is extended, collapsing the connecting link 20 until the second set of holes 37 are aligned. The insertion of the second pin 42 through the aligned second set of holes 37 reduces the effective length of the connecting link 20 so that the bucket 15 can be rolled back into a position C shown in FIG. 1 in dotted lines. During such transport, the first pin 40 can be carried in the holes 41 through the straps 23 rearwardly of the second member 26.

When the connecting link 20 is positioned in the transport position as shown in FIGS. 4 and 5 with the second pin 42 engaged through the aligned second set of holes 37 the bucket 15 will have a range of motion indicated in FIG. 1 in dotted lines between the fully retracted position C and a fully extended position D, which is unacceptable for efficient operation for the bucket loader 10. Furthermore, the second pin 42 is sized to shear if the bucket loader 10 is operated while the connecting link 20 is positioned in the transport position. Accordingly, after transport in compliance with the regulations as noted above, the connecting link 20 must be returned to the operative position by withdrawing the second pin 42, retracting the hydraulic cylinder 18 to move the first member 22 rearwardly relative to the second member 26 until the first set of holes 32 are realigned for insertion of the first pin 40. To further stabilize the connecting link 20 in the operative position as shown in FIGS. 2 and 3, the first set of holes 32 are positioned so that the retaining plate 29 is engaged with the reinforcing plates 24. As noted above, the second pin 42 can be carried in the straps 23 through the corresponding holes 43 while the connecting link 20 is in the operative position.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts as based upon the description may be employed in other embodiments without departing from the scope of the invention. Accordingly, the following claims are intended to protect the invention broadly as well as in the specific form shown.

Having thus described the invention, what is claimed is:

1. In a bucket loader mountable on a tractor to extend forwardly of said tractor for operation, said bucket loader having a bucket positioned forwardly of said tractor and a longitudinally extending mounting frame including a pair of transversely spaced support arms pivotally connected at a first end to said tractor and pivotally supporting said bucket from a remote second end, said mounting frame further including a control linkage interconnecting said support arms and said bucket to control the pivotal movement of said bucket about said second end of said support arms, said control linkage including a selectively extensible hydraulic cylinder fastened to one of said support arms and a connecting link interconnecting said hydraulic cylinder and said bucket at a position remote from said second end of said support arms, an improved connecting link comprising:

a first member pivotally connected to said hydraulic cylinder;

a second member telescopically associated with said first member and being pivotally connected to said bucket; and limit means interconnecting said first and second members to restrict the telescopic movement therebetween.

2. The bucket loader of claim 1 wherein said limit means is operable to position said first and second members in an operative position and in a transport position, the distance from the connection between said connecting link and said first member to the connection between said bucket and said second member being greater for said operative position than for said transport position.

3. The bucket loader of claim 2 wherein said limit means includes a first pin engageable through an alignable first set of holes in said first and second members, said first pin having a size to withstand forces exerted through said connecting link during operation of said bucket when said connecting link is in said operative position.

4. The bucket loader of claim 3 wherein said limit means further includes a second pin engageable through a second set of holes in said first and second members when said connecting link is in said transport position, said first set of holes being misaligned when said second set of holes are aligned, said second pin having a size incapable of withstanding forces exerted through said connecting link during operation of said bucket.

5. The bucket loader of claim 4 wherein said first member carries said first pin out of engagement with said second member when said connecting link is in said transport position.

6. The bucket loader of claim 5 wherein said second member is telescopically received within said first member.

7. The bucket loader of claim 6 wherein said first member carries said second pin out of engagement with said second member when said connecting link is in said operative position.

8. The bucket loader of claim 7 wherein said control linkage includes a pair of hydraulic cylinders fixed, respectively, to said support arm and extending forwardly therefrom for attachment to a pair of corresponding transversely spaced connecting links movable between transport and operative positions.

9. A mounting frame for operatively supporting a loader bucket forwardly of a tractor, comprising:

a pair of transversely spaced support arms pivotally connected at a first end to said tractor and extending forwardly to a remote second end pivotally connected to said loader bucket;

pivot control linkage connected to said loader bucket remotely from said second ends of said support arms to control the pivotal movement of said loader bucket about said second ends of said support arms;

hydraulic cylinders interconnecting said support arms and said pivot control linkage to effect pivotal movement of said loader bucket; and said pivot control linkage including a pair of connecting links corresponding, respectively, to said hydraulic cylinders, each said connecting link including:

a first member connected to the corresponding said hydraulic cylinder;

a second member connected to said loader bucket and being telescopically associated with said first member such that an effective length of said connecting links between the corresponding said hydraulic cylinder and said loader bucket is variable; and limit means engageable with said first and second members to limit the telescopic movements of said first and second members, said limit means being operable to position said connecting link in an operative position and in a transport position, the effective length of said connecting link being greater in said operative position than in said transport position.

10. The mounting frame of claim 9 wherein said limit means includes first and second pins engageable with first and second sets of alignable holes, respectively, through said first and second members, said first and second sets of holes being positioned to prevent simultaneous alignment, one of said pins being engageable with said first and second members through a corresponding set of aligned holes while the other said pin is carried by said first member out of engagement with said second member.

11. The mounting frame of claim 10 wherein said first pin has a size capable of withstanding forces exerted through the corresponding said connecting link during operation of said loader bucket, said second pin having a size incapable of withstanding said operational forces, said first pin engaging said first and second members when the corresponding said connecting link is in said operative position, said second pin engaging said first and second members when the corresponding said connecting link is in said transport position.

12. The mounting frame of claim 11 wherein said second member is telescopically received within said first member.

* * * * *